US005306074A

United States Patent [19]

Mocur

[11] Patent Number: 5,306,074

[45] Date of Patent: Apr. 26, 1994

[54] AMPUTEE ATTACHMENT FOR A WHEELCHAIR

[76] Inventor: Paul Mocur, 45685 Greenridge Dr., Northville, Mich. 48167

[21] Appl. No.: 894,950

[22] Filed: Jun. 8, 1992

[51] Int. Cl.[5] ..... A47C 7/50

[52] U.S. Cl. ..... 297/423.31; 297/423.30; 297/466

[58] Field of Search ..... 297/433–435; 5/624, 650

[56] References Cited

U.S. PATENT DOCUMENTS

| | | | |
|---|---|---|---|
| 439,088 | 10/1890 | Allen | 297/433 X |
| 473,122 | 4/1892 | Leonard et al. | 297/433 X |
| 507,921 | 10/1893 | O'Brien | 297/433 X |
| 1,053,214 | 2/1913 | Poll | 297/434 X |
| 2,826,242 | 3/1958 | Thompson . | |
| 3,858,938 | 1/1975 | Kristensson | 297/433 X |
| 3,861,745 | 1/1975 | Forrest | 297/433 X |
| 4,486,048 | 12/1984 | Meyer | 297/433 |
| 4,886,258 | 12/1989 | Scott | 5/624 |
| 5,033,793 | 7/1991 | Quintile | 297/433 |
| 5,179,746 | 1/1993 | Rogers | 5/625 |

FOREIGN PATENT DOCUMENTS

| | | | |
|---|---|---|---|
| 675712 | 7/1952 | United Kingdom | 297/466 |

*Primary Examiner*—Peter R. Brown
*Attorney, Agent, or Firm*—Charles W. Chandler

[57] ABSTRACT

A body support unit is installable in a wheelchair to facilitate use of the wheelchair by a user having a leg amputated below the knee. The support unit includes a seat member and a leg support panel extending forwardly from the front edge of the member for supporting the user's amputated leg. The panel is hingedly suspended from the seat member for movement to a lowered position that allows the user to get into and out of the wheelchair without interference by the panel. A flexible strap-type leg restraint is mounted on the panel to immobilize the amputated leg in a horizontal position while the user is seated in the wheelchair.

23 Claims, 2 Drawing Sheets

AMPUTEE ATTACHMENT FOR A WHEELCHAIR

FIELD OF THE INVENTION

This invention relates to wheelchairs, and particularly to an attachment that can be installed on a conventional wheelchair to provide horizontal support for a user's leg that has been amputated below the knee.

PRIOR ART DEVELOPMENTS

Conventional wheelchairs commonly are built as collapsible frame structures carried by two sets of wheels. The user moves the chair by exerting hand pressure on two annular rails attached to the rear wheels. The forward wheels are usually caster wheels that swivel for steering and maneuvering the wheelchair.

Most wheelchairs have two leg support units for supporting the user's legs while he/she is sitting in the chair. Each leg support unit comprises a tubular strut that extends downwardly and forwardly from the chair frame. A retractable foot rest is attached to the lower end of the tubular strut. A retractable calf-support plate is attached to the midportion of the tubular strut. Each footplate and calf-support plate can be swung outwardly away from the space in front of the wheelchair to make it easier for the user to get into or out of the chair.

Conventional leg support units are not fully effective for supporting a leg amputated below the knee. The reason is that they permit the muscles behind the leg to progressively contract. The stump below the knee gradually bends under the thigh.

Leg support units for wheelchairs are shown in U.S. Pat. No. 4,486,048 to W. Meyer, and U.S. Pat. No. 2,826,242 to H. Thompson, and U.S. Pat. No. 5,033,793 to M. Quintile. In each case, the leg-engagement surface is spaced forwardly from the front edge of the wheelchair seat, such it does not effectively support an amputated leg of the wheelchair user.

SUMMARY OF THE INVENTION

The present invention relates to an amputee attachment that can be used on conventional wheelchairs to support the amputated leg of a user of the wheelchair. In one embodiment of the invention, the attachment comprises a seat removably installed on a wheelchair. A leg support panel is hingedly connected adjacent the front edge of the seat for swinging motion between a raised position forming a horizontal extension of the top surface of the seat, and a lowered position extending downwardly from the seat. The seat and panel thus form an essentially continuous support surface for the buttocks, thigh, and that portion of the leg remaining below the knee.

In a typical construction, the amputee attachment panel has a length of about eleven inches. The free end of the panel is located forwardly beyond the position of the user's kneecap. The panel effectively supports a user having a leg amputated below the knee. Also, the panel tends to prevent the user's amputated leg from curling toward the thigh due to contraction of the leg muscles (resulting from prolonged sitting in a wheelchair without adequate support).

The amputee attachment panel has a width slightly less than one half the seat width. The panel supports the weight of the amputated leg, while the user's other leg and foot are supported by the conventional leg support unit. The amputee attachment panel is swung down to its lowered position to facilitate movement of the user into or out of the wheelchair. The attachment can be used for an amputee with either a right or left amputated leg, or in a pair for a bi-lateral amputee.

A spring mechanism is incorporated into the hinge structure for the panel to assist the user in raising the panel. A manually-actuated latch structure holds the panel in its raised position.

Preferably, the seat is rigid to hingedly suspend the panel. The seat is neither flexible nor deflectable under the user's weight. Also, the seat and panel are a self-contained unit installable on a range of conventional wheelchairs without structural modification of the wheelchair.

The amputee attachment panel has two guides for mounting a flexible, strap-type leg restraint. The restraint includes a pad designed to fit over the user's kneecap, and a strap that wraps around the panel to immobilize the leg in a horizontal position. The leg restraint can be placed around or removed from the leg by the user.

THE DRAWINGS

DESCRIPTION OF A PREFERRED EMBODIMENT OF THE INVENTION

Figure 1:
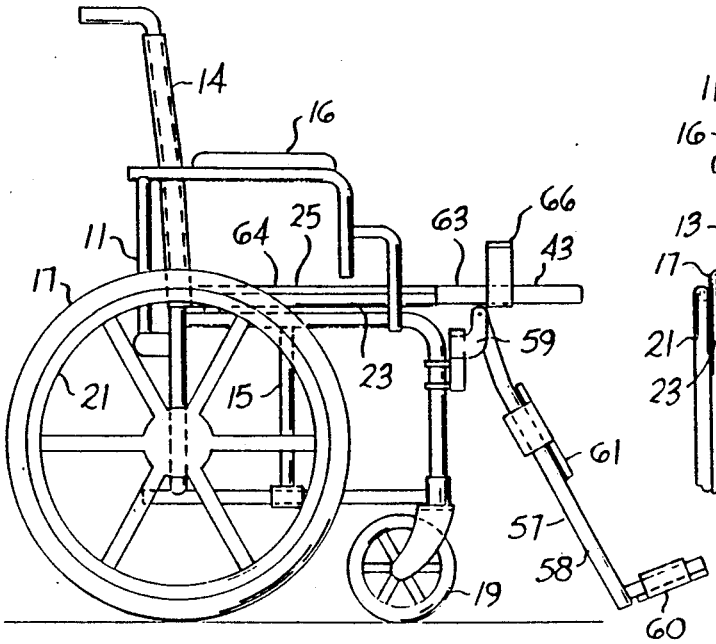
FIG. 1 is a side elevational view of a wheelchair having an amputee attachment of the present invention.
Figure 2:
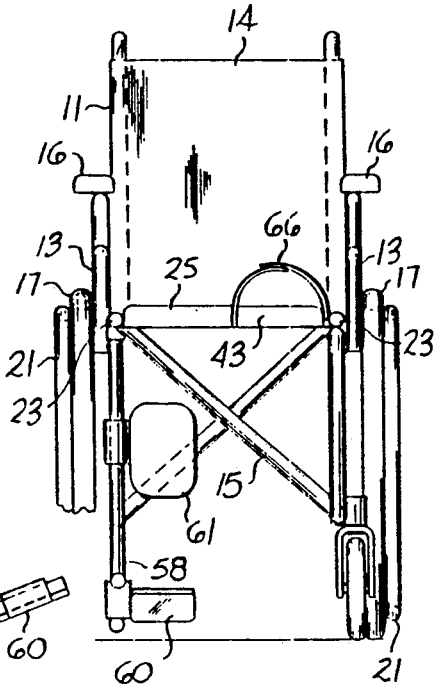
FIG. 2 is a front elevational view of the FIG. 1 wheelchair.

FIGS. 1 and 2 show a conventional wheelchair 11 that includes two side frames 13 connected to each other by an X-shaped transverse linkage 15. The two side frames can be collapsed together for storage. Each side frame is formed of tubular frame elements suitably welded together to form a rigid frame structure that supports a fabric seat back 14 and two arm rests 16. The frame structure is supported for movement by two large rear wheels 17 and two smaller front wheels 19. Each smaller wheel is a caster wheel, whereby the wheelchair can be steered by the user.

An annular hand rail 21 is attached to each rear wheel 17, such that the user sitting in the wheelchair can move the wheelchair from place to place by pulling or pushing one or both hand rails in a circular motion. The user sits in the wheelchair with his/her buttocks resting on a rectangular seat member 25 supported horizontally between side frames 13.

The side frames include horizontal tubular bars 23 extending in a front-to-rear direction. Seat member 25 has four curved brackets 27 (FIGS. 3 and 4) adapted to overlie and partially encircle bars 23. The seat member is removably supported on the two bars. The seat member is removed from the wheelchair by raising the seat member and the surface brackets from support bars 23. Each bar 23 has a bracket 28 with a forwardly extending finger 29 spaced a slight distance above the bar surface. The seat member is manipulated so that the two rearmost brackets 27 slide underneath the associated fingers 29. The fingers prevent inadvertent upward movement of the seat member.

The seat member can also be mounted on a standard sling seat by removing curved brackets 27.

Figure 3:
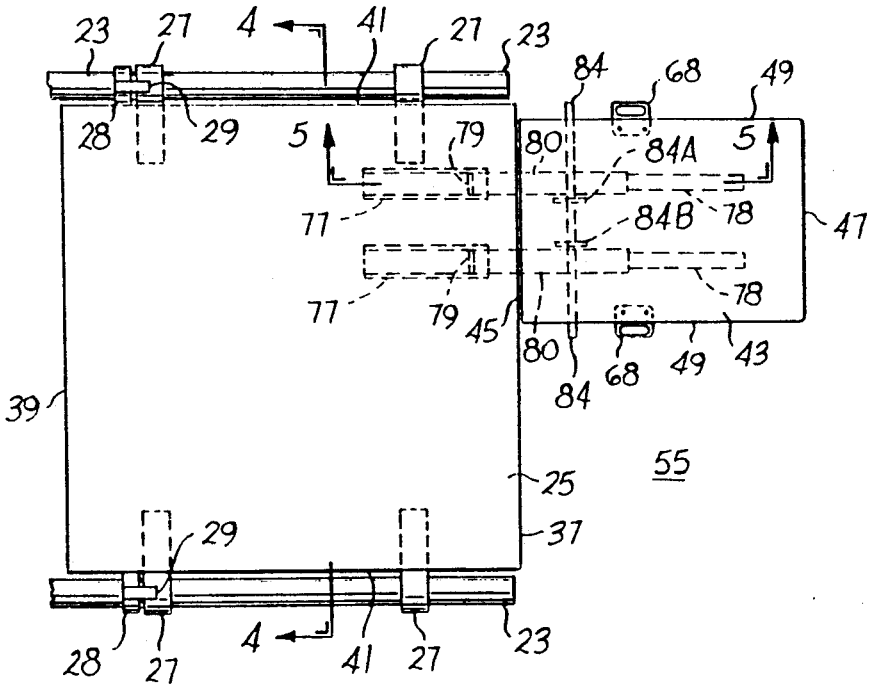
FIG. 3 is an enlarged top plan view of the amputee attachment used in the FIG. 1 wheelchair.
Figure 4:
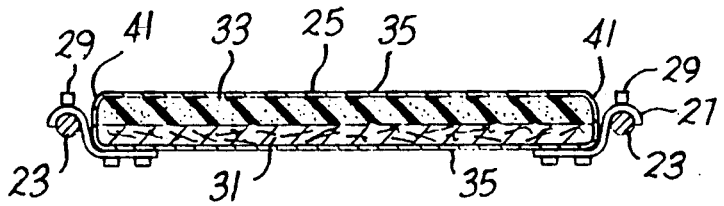
FIG. 4 is a sectional view taken on line 4—4 in FIG. 3.

Seat member 25 includes a rigid plywood element 31, foam rubber cushion 33, and flexible plastic covering 35. Plywood element 31 typically has a thickness of about three quarter inch. As seen in FIG. 3, the seat member has a front edge 37, rear edge 39, and side edges 41. The side-to-side width dimension of the seat member is about sixteen inches.

The invention is concerned primarily with an add-on amputee support panel 43 that has a rear edge 45, front edge 47, and two side edges 49. The panel is formed of materials similar to those used for seat member 25, i.e. a rigid plywood element 51, foam rubber cushion 52, and flexible covering 53. As seen in FIG. 3, panel 43 has a side-to-side width dimension slightly less than one half the width dimension of the seat member. Typically the width dimension of panel 43, as measured between side edges 49, is approximately seven inches. The length dimension of the panel (measured between end edges 45 and 47) is approximately ten or eleven inches, i.e. about one and one half times the panel width dimension.

Panel 43, shown in FIG. 3, is illustrated attached to the left half of seat member 25. However, the panel could be attached to the right half of the seat member, or employed in a pair at both halves of the seat for a bi-lateral amputee. When a user having an amputated left leg sits on the seat member, the amputated leg rests on the panel. The vacant space 55 to the right of panel 43 accommodates the user's right leg.

The wheelchair has a conventional leg support unit 57 that supports the user's normal length leg and foot. As seen in FIGS. 1 and 2, support unit 57 comprises a tubular strut 58 pivotably attached to a bracket 59 at the forward end of side frame 13. Strut 58 carries a foot rest 60, and a calf support plate 61. The foot rest and calf support plate can be swingably retracted away from the space in front of the wheelchair, thereby affording the user passage into or out of the chair.

Seat member 25 and leg support panel 43 can be installed as a unit into the wheelchair without removing the conventional support unit 57. Normally, the wheelchair has two conventional leg support units 57. Either of these support units can remain in place when the amputee attachment unit (members 25 and 43) is installed in the wheelchair.

Figure 5:
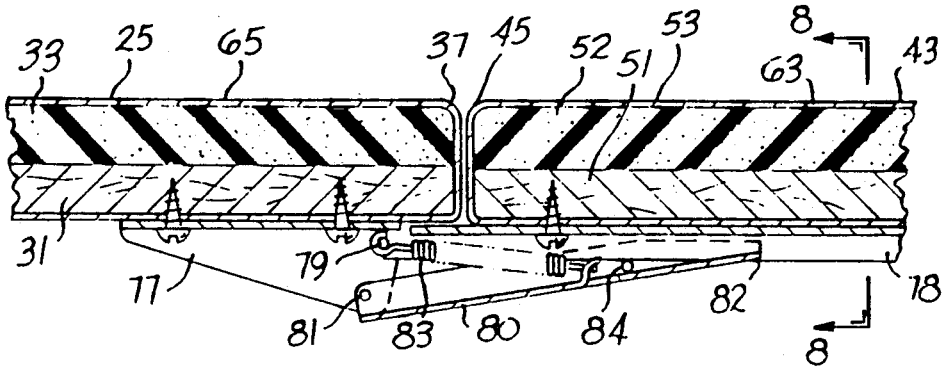
FIG. 5 is a fragmentary enlarged sectional view taken on line 5—5 in FIG. 3.

FIG. 5 shows the leg support panel in a raised horizontal position for supporting the user's thigh. End 45 of the leg support panel is close to the front edge 37 of seat member 25, but slightly spaced to avoid pinching the user's leg. The top surface of the seat and the panel form a substantially continuous support surface for the user's buttocks, thigh and leg remaining below the knee.

A flexible leg restraint 66 is carried on panel 43 to immobilize the leg resting on the panel. The restraint comprises a single flexible strap 67 extending through two aligned guides 68 located on the side edges of the panel. The central portion of the strap lies against the bottom surface of the panel. The straps end portions 69 and 70 are connected around the user's leg to restrain its movement with respect to the panel. A kneecap pad 71 is attached to the undersurface of strap end portion 69, such that the strap restraint force is distributed over a greater knee surface area. The kneecap pad has a central opening 72 for receiving the kneecap.

Figure 7:
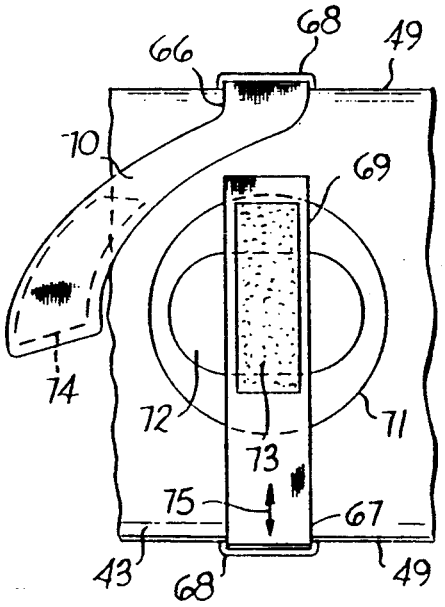
FIG. 7 is a plan view of a flexible leg restraint usable with the leg support panel shown in FIG. 3.
Figure 8:
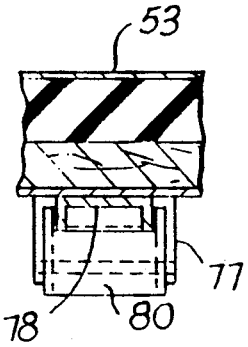
FIG. 8 is a fragmentary sectional view taken on line 8—8 in FIG. 5.

The strap's end portions 69 and 70 may be connected together in various ways, e.g. by cooperating buckle elements. As shown schematically in FIG. 7, a first patch of fibrous hook-and-loop material 73 is carried on the exposed surface of strap end portion 69, and a second, complementary patch of fibrous hook-and-loop material 74 is carried on the undersurface of strap end portion 70. Such hook-and-loop materials are commercially available under the trademark VELCRO. The overlapped strap end portions are connected by pressing the patches together in the known manner.

Kneecap pad 71 is shown in a central position above panel 43. However the pad can be relocated by shifting the strap through aligned guides 68, as indicated by arrows 75. Thus the pad accommodates different kneecap thicknesses and positions above the panel. The user can shift the strap location unassisted.

Figure 6:
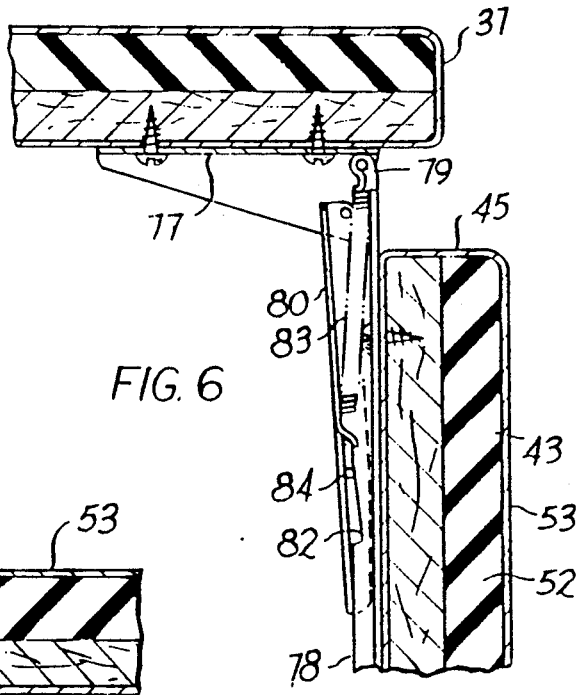
FIG. 6 is a view taken in the same direction as FIG. 5, but with the leg support in a lowered position.

When leg support panel 43 is in the raised, operative position shown in FIGS. 1 and 5, it is difficult for the user to easily get into or out of the wheelchair. Therefore, the leg support panel is hingedly attached to seat member 25, so that the panel can be swung down to the lowered position depicted in FIG. 6. As shown in FIG. 3, the hinge connection between the leg support panel and the seat member comprises two channel-shaped brackets 77 secured to the bottom surface of seat member 25, and two mating channel-shaped brackets 78 secured to the bottom surface of panel 43. The overlapping ends of the mating brackets are hingedly connected by transverse pivot pins 79. FIGS. 5 and 6 show one set of brackets; the companion set of brackets is similarly constructed.

As viewed in FIGS. 5 and 6, a representative pivot pin 79 is located near the seat bottom surface at a point spaced rearwardly from seat front edge 37. The location of the pivot pin is adjusted to permit a small clearance between seat member and the leg support panel so that the user is not pinched when the leg support panel is raised. Therefore, when panel 43 is swung downwardly to its lowered position, it is located approximately beneath the seat front edge. The panel is located so as not to obstruct the passage of the user getting into or out of the wheelchair.

A latch means supports panel 43 in its raised position (FIG. 5). The latch means comprises two elongated channel cross-sectioned latch bars, one of which is shown at 80 in FIGS. 5 and 6. One end of latch bar 80 is pivotably connected to bracket 77 by a transverse pivot pin 81. The other, free end of the latch bar extends into a detent recess 82 formed in the flanges of bracket 78. When panel 43 is in its raised position, bar 80 fits into recess 82 to support the panel. The latch bar is held in the FIG. 5 position by an elongated tension coil spring 83 trained between the bar and pivot pin 79. The two latch bars 80 (FIG. 3) are interconnected by a transverse actuator rod 84, having a length greater than the width dimension of panel 43. The rod ends extend beyond panel side edges 49, such that the wheelchair user can grasp either end of the rod. A pair of cotter pins 84A and 84B mounted on rod 84 just inboard of latch bars 80, prevent rod 84 from sliding out of the user's reach.

With panel 43 in its FIG. 5 raised position, the user has to raise his leg to release the weight from panel 43, then a downward manual force on either end of rod 84 moves latch bars 80 downwardly out of recesses 82. Panel 43 thereby moves downwardly to the FIG. 6 lowered position under its gravitational weight. Rod 84 cannot be moved downwardly with the user's let on the panel which provides a safety feature preventing accidental release of the panel.

With panel 43 in its FIG. 6 lowered position, the user can raise the panel by a manual force. As the panel swings in an upward arc around pivot pin 79, the angle of coil spring 83 changes to exert an upward pulling force on latch bar 80 and panel 43. The spring thus provides an additional lifting force that augments the manual lifting force. If the spring is sufficiently stressed, the spring force can provide substantially all (or a major part) of the required panel lifting force. In the position of FIG. 6, the spring exerts no lifting force on the panel. During the upward swinging motion of the panel, the free end of each latch bar 80 slides along the edge surface of the associated brackets 78 until the latch bar end snaps into recesses 82. At this point the panel is in its raised position (FIG. 6).

The drawings show the hinge means as comprising two brackets 77 and two mating brackets 78. However, one larger bracket 77 and one larger (wider) bracket could be used, in which case only a single latch bar 80 would be utilized.

A principal feature of this invention is the relationship between the seat member 25 and leg support panel 43. The panel top surface forms a substantial continuation of the seat member top surface. This arrangement provides a large surface for supporting the amputated leg. The leg restraint shown in FIG. 7 immobilizes the amputated leg in a horizontal position with the knee joint being held close to the panel top surface, preventing the leg muscles from contracting to the extent of deforming the leg.

As shown in FIGS. 5 and 6, the leg support panel is hingedly attached to the seat member for movement to a lowered position that facilitates movement of the user into or out of the wheelchair. The latch actuator rod is readily accessible for raising or lowering the panel.

The seat member and attached leg support panel form a unitary body support unit that can readily be installed on a variety of conventional wheelchairs without modifying the wheelchair construction.

While a specific embodiment of the invention is shown and described, some changes and variants can be made while still practicing the invention.

What is claimed is:

1. In a wheelchair having a seat, wherein said seat has a bottom surface, a top surface, a front edge, and two side edges; the improvement comprising a leg support panel; hinge means suspending said panel from the seat at a point near the seat front edge so that the panel is swingable between a raised position in planar alignment with the seat and a lowered position extending downwardly in a plane extending generally vertically through the seat front edge; said leg support panel having a top surface that is substantially contiguous with the seat top surface when said panel is in its raised position; a manually-operated latch means for releasable holding said panel in its raised position; and an overcenter spring means trained between the seat and the panel for exerting a lifting force on the panel when the panel is manually swung toward its raised position and which does not exert a lifting force when the panel is in said lowered position.

2. The improvement of claim 1, wherein said hinge means comprises a first bracket secured to the seat bottom surface, a second bracket secured to the panel bottom surface, and a pivot pin extending between said brackets parallel to the seat front edge; said pivot pin being located near the seat bottom surface at a point spaced rearwardly from the seat front edge, whereby the panel is placed downwardly from the seat front edge when it is in its lowered position.

3. The improvement of claim 2, wherein said latch means comprises a detent recess in said second bracket, and an elongated latch bar having one end thereof pivotably connected to said first bracket at a point below said pivot pin; said latch bar having a free end adapted to extend into the detent recess to support the panel against downward collapse from its raised position.

4. The improvement of claim 3, wherein said latch means comprises a manual actuator rod extending transversely through said latch bar parallel to said pivot pin.

5. The improvement of claim 4, wherein said leg support panel has two side edges and two end edges extending parallel to the seat front edge; said manual actuator rod having a length greater than the side-to-side width of the panel, whereby the rod extends beyond the panel side edges for access purposes.

6. The improvement of claim 4, wherein said spring means comprises a tension coil spring having one end connected to said pivot pin and its other end connected to said latch bar, said spring means being operable to maintain the free end of the latch bar in slidable engagement with the second bracket while the leg support panel is being lifted to its raised position.

7. The improvement of claim 1, wherein said leg support panel has two side edges and two end edges extending parallel to the seat front edge; said panel having a width dimension measured between its side edges, and a length dimension measured between its end edges; the panel width dimension being slightly less than one half the width dimension of the seat; the panel length dimension being approximately one and one half times the panel width dimension.

8. The improvement of claim 7, and further comprising a leg restraint means extending transversely across the leg support panel generally parallel to the panel end edges; said leg restraint means comprising a pad adapted to fit over the user's kneecap, and flexible strap means extendable around the user's leg to position said pad on the kneecap.

9. The improvement of claim 8, wherein said strap means comprises a single strap having a central portion extending along the panel above the panel bottom surface, and end portions extendable over the user's leg; said strap having a sufficient length that the strap end portions can overlap to encircle the user's leg.

10. The improvement of claim 9, wherein said kneecap pad is carried by an end portion of the strap; said strap being shiftable in the direction of its length, whereby the kneecap pad can be centered on the user's kneecap.

11. A body support unit installable on a wheelchair, whereby the wheelchair can be used by a user having a leg amputated below the knee; said body support unit comprising a seat having a bottom surface, a top surface, a front edge, and two side edges; a leg support panel having a bottom surface, a top surface, two side edges, and two end edges; hinge means suspending said panel from the seal so that the panel is swingable between a raised position in substantial planar alignment with the seat, and a lowered position extending downwardly; the top surface of the panel being substantially contiguous with the seat top surface when said panel is in its raised position; a manually-operated latch means for releasable holding said panel in its raised position; and an over-center spring means trained between the seat and the panel for exerting a lifting force on the panel when the panel is manually swung toward its raised position and which does not exert a lifting force when the panel is disposed in said lowered position.

12. The body support unit of claim 11, wherein said hinge means comprises a first bracket secured to the seat bottom surface, a second bracket secured to the panel bottom surface, and a pivot pin extending between said brackets parallel to the seat front edge; said latch means comprising a detent recess in said second bracket, and an elongated latch bar having one end thereof pivotably connected to said first bracket; said latch bar having a free end thereof adapted to extend into the detent recess to support the panel against downward collapse from its raised position; said spring means comprising a tension coil spring trained between the first bracket and the latch bar for pulling the latch bar into engagement with the second bracket.

13. The body support unit of claim 12, wherein said latch means comprises a manual actuator rod extending transversely though said latch bar parallel to said pivot pin so that opposite ends of the rod extend beyond the side edges of the leg support panel.

14. The body support unit of claim 12, wherein the detent recess receives the free end of the latch bar such that the weight of the user must be removed from the panel before the latch means can be moved to remove the latch bar from the detent recess.

15. In a wheelchair having a seat, wherein said seat has a bottom surface, a top surface, a front edge, and two side edges, the improvement comprising:

a leg support panel;

hinge means suspending said panel from the seat at a point near the seat front edge so that the panel is swingable between a raised position in planar alignment with the seat and a lowered position extending downwardly in a plane extending generally vertically through the seat front edge;

said leg support panel having a top surface that is substantially contiguous with the seat top surface when said panel is in its raised position;

a manually-operated latch means for releasable holding said panel in its raised position;

an over-center spring means trained between the seat and the panel for exerting a lifting force on the panel when the panel is manually swung toward its raised position and which does not exert a lifting force when the panel is in said lowered position;

said leg support panel having two side edges and two end edges extending parallel to the seat front edge;

said panel having a width dimension measured between its side edges, and a length dimension measured between its end edges; the panel width dimension being slightly less than one half the width dimension of the seat; the panel length dimension being approximately one and one half times the panel width dimension;

a leg restraint means extending transversely across the leg support panel generally parallel to the panel end edges; said leg restraint means comprising a pad adapted to fit over the user's kneecap, and flexible strap means extendable around the user's leg to position said pad on the kneecap;

said strap means comprising a single strap having a central portion extending along the panel above the panel bottom surface, and end portions extendable over the user's leg; said strap having a sufficient length that the strap end portions can overlap to encircle the user's leg; and wherein said kneecap pad is carried by an end portion of the strap; said strap being shiftable in the direction of its length, whereby the kneecap pad can be centered on the user's kneecap.

16. A body support unit installable on a wheelchair having support structure for the body support unit, whereby the wheelchair can be sued by a user having a leg amputated below the knee; said body support unit comprising:

a seat having a bottom surface, a top surface, a front edge, and two side edges;

a leg support panel having a bottom surface, a top surface, two side edges, and two end edges;

hinge means suspending said leg support panel from the seat along a hinge axis line located near the seat front edge so that the leg support panel is swingable between a raised portion in planar alignment with the seat, and a lowered position extending downwardly in a plane extending generally vertically through the seat front edge;

the top surface of the leg support panel being substantially contiguous with the seat top surface when said leg support panel is in its raised position;

a manually-operated latch means for releasable holding said leg support panel in said raised position;

a leg restraint means extending transversely across the leg support panel generally parallel to the panel end edges; said leg restraint means comprising a pad adapted to fit over the user's kneecap;

flexible strap means extendable around the user's leg to position said pad on the kneecap;

two aligned strap guides carried by the leg support panel at its side edges; said strap means comprising a single strap extending through the aligned guides;

said strap having a central portion lying against the leg support panel bottom surface, and end portions extendable over the user's leg;

said strap having a length whereby the strap end portions overlap when the strap is extended around the user's leg;

said kneecap pad being attached to an end portion of the strap;

said strap being adjustably movable through the aligned guides, whereby the kneecap pad can be centered on the user's kneecap irrespective of anatomical peculiarities in the user's amputated leg.

17. A seat assembly for a wheelchair of a leg amputee, the wheelchair having a frame with a pair of spaced parallel tubular bars for supporting a standard seat unit between them, comprising:

a padded seat member having a bottom surface, a top surface, a front edge and two side edges and a width between the side edges accommodating the distance between the tubular bars of the wheelchair;

a padded leg support member having a bottom surface, a top surface, two side edges and two end edges;

bracket means mounted along each of the side edges of the padded seat member for engaging the parallel tubular bars to support the seat member between the tubular bars;

a hinge bracket mounted on the bottom surface of one of the padded members adjacent an edge thereof;

a hinge member mounted on the bottom surface of the other of the padded members;

a first hinge pin means for interconnecting the hinge member to the hinge bracket such that the padded leg support member is pivotal about a first hinge axis with respect to the padded seat member between an upper position in which the top surface of the padded leg support member is substantially contiguous with the top surface of the padded seat member, and a lower position in which the padded leg support member is disposed generally at right angles with respect to the padded seat member;

an elongated latch bar having an outer end;

second hinge pin means for interconnecting the latch bar to the hinge bracket for pivotal motion about a second hinge axis parallel to the first hinge axis but spaced therefrom, such that the outer end of the latch bar is swingable about the second hinge axis;

recess means on the hinge member for engaging the outer end of the latch bar when the leg support member is disposed in said upper position;

an over-center elongated coil spring member having first and second ends, the first end of the spring member being connecting to said one of the padded members, and the second spring end being connected to the latch bar in a position spaced from the second hinge pin means to bias the outer end of the latch bar toward the first hinge member except when the padded seat member is in said lower position.

18. A portable seat assembly as defined in claim 17, in which the first end of the spring member is anchored to the first hinge pin means.

19. A portable seat assembly as defined in claim 17, in which the padded seat member and the padded leg support member are removable as a unit from the wheelchair frame.

20. A portable seat assembly as define din claim 17, in which the first end of the elongated spring is connected to the first hinge pin means in such a manner that when the leg support member is disposed in said lower position, the spring member imposes substantially no torque on the latch bar.

21. A portable seat assembly as defined in claim 17, in which the hinge member is mounted on the bottom of the padded leg support member.

22. A portable seat assembly as defined in claim 17, the hinge member comprises a first channel-shaped member, and the latch bar comprises a second channel-shaped member and a portion of one of the channel-shaped members is nestably received in the other channel-shaped member when the latch bar engages the recess means.

23. A portable seat assembly as defined in claim 17, the latch bar being releasable from the recess means only by a pivotal motion of the leg support member away from the outer end of the latch bar.

* * * * *